US011535023B2

(12) United States Patent
Bazin

(10) Patent No.: US 11,535,023 B2
(45) Date of Patent: Dec. 27, 2022

(54) DOCTOR BLADE, DOCTOR BLADE CHAMBER, AND PRINTING UNIT EQUIPPED THEREWITH

(71) Applicant: Bobst Lyon, Villeurbanne (FR)

(72) Inventor: Rene Bazin, Farnay (FR)

(73) Assignee: BOBST LYON, Bron (FR)

( * ) Notice: Subject to any disclaimer, the term of this patent is extended or adjusted under 35 U.S.C. 154(b) by 0 days.

(21) Appl. No.: 17/255,366

(22) PCT Filed: Jul. 15, 2019

(86) PCT No.: PCT/EP2019/025234
§ 371 (c)(1),
(2) Date: Dec. 22, 2020

(87) PCT Pub. No.: WO2020/015860
PCT Pub. Date: Jan. 23, 2020

(65) Prior Publication Data

US 2021/0260865 A1 Aug. 26, 2021

(30) Foreign Application Priority Data

Jul. 18, 2018 (FR) ..... 18/56648

(51) Int. Cl.
*B41F 9/10* (2006.01)
*B41F 5/24* (2006.01)

(52) U.S. Cl.
CPC ..... *B41F 9/1072* (2013.01); *B41F 5/24* (2013.01)

(58) Field of Classification Search
CPC ..... B41F 9/1072; B41F 5/24; B41F 31/04; B41F 9/10; B05C 11/044; B05C 1/083;
(Continued)

(56) References Cited

U.S. PATENT DOCUMENTS 1,845,716 A * 2/1932 Lafore ..... D21G 3/005 15/256.51
4,802,928 A * 2/1989 Dunlap ..... B05C 11/04 134/15

(Continued)

FOREIGN PATENT DOCUMENTS

CN 101570080 A 11/2009
CN 101668635 A 3/2010

(Continued)

OTHER PUBLICATIONS

International Search Report dated Nov. 5, 2019, in counterpart International Patent Application No. PCT/EP2019/025234 (2 pages).

*Primary Examiner* — Leslie J Evanisko
*Assistant Examiner* — Leo T Hinze
(74) *Attorney, Agent, or Firm* — Bookoff McAndrews, PLLC

(57) ABSTRACT

A doctor blade, intended for a doctor blade chamber (6) for a flexography printing unit (1) equipped with a screened cylinder (4), presents in the form of a rectangular blade, with a functional longitudinal side (34) of which a longitudinal edge is capable of making contact with the screened cylinder (4), a longitudinal fastening side (33) and two lateral sides (36, 37).

The doctor blade comprises at least one opening located towards the functional longitudinal side (34) and towards the first of the two lateral sides (36, 37).

20 Claims, 4 Drawing Sheets

(58) Field of Classification Search
CPC ..... B05C 1/0834; B05C 1/0813; B05C 3/005; B05C 11/045; B41N 10/005; D21G 3/005
See application file for complete search history.

(56) References Cited

U.S. PATENT DOCUMENTS 5,735,209 A * 4/1998 Achelpohl ..... B41F 35/00 101/363
6,832,551 B2 * 12/2004 Jendroska ..... B41F 31/027 101/350.6

FOREIGN PATENT DOCUMENTS

| | | | |
|---|---|---|---|
| CN | 103419484 | A | 12/2013 |
| CN | 205112658 | U | 3/2016 |
| CN | 205674679 | U | 11/2016 |
| CN | 108290409 | A | 7/2018 |
| CN | 107614266 | B | 6/2019 |
| DE | 2305831 | A1 | 8/1974 |
| DE | 10150488 | A1 | 4/2003 |
| DE | 102006018525 | A1 | 10/2007 |
| ES | 2317299 | | 4/2009 |
| JP | H471251 | U | 6/1992 |
| JP | H09123413 | A | 5/1997 |
| JP | H11254648 | A | 9/1999 |
| JP | 2002137367 | A | 5/2002 |

* cited by examiner

DOCTOR BLADE, DOCTOR BLADE CHAMBER, AND PRINTING UNIT EQUIPPED THEREWITH

CROSS-REFERENCE TO RELATED APPLICATION(S)

This application is a National Stage under 35 U.S.C. § 371 of International Application No. PCT/EP2019/025234, filed on Jul. 15, 2019, which claims priority to French Patent Application No. 18/56648, filed on Jul. 18, 2018, the contents of all of which are incorporated by reference in their entirety.

The present invention relates to doctor blade, which is designed to be mounted on a doctor blade chamber for a flexography printing unit. The invention relates also to a doctor blade chamber, including at least two doctor blades. The invention concerns a printing unit in a printing machine, equipped with a doctor blade chamber including at least two doctor blades.

A flexographic printing machine is used in the packaging industry for the printing of a continuous band or plate elements, such as flexible materials, labels, sheets of paper, polyethylene film, flat cardboard and corrugated cardboard. The machine includes one or several printing units that are placed one after the other, each of the printing units printing one color.

A printing unit includes in particular a plate cylinder, around which a printing form is rolled up and stretched, namely, a flexible printing plate presenting relief patterns. The plate cylinder prints the patterns with the same color during each of its rotations. The printing plate prints the sheet after having been coated in ink, through a screened cylinder provided with cells, called an anilox, and a inking device. The inking device comprises a doctor blade chamber, configured to fill the cells of the screened cylinder with a precise volume of ink, an ink tank, and at least one pump, ensuring the delivery of the ink from the ink tank to the doctor blade chamber.

STATE OF THE ART

The screened cylinder must be scraped regularly and accurately by the doctor blades of the doctor blade chamber, in such a way that only the necessary and sufficient quantity of ink fills the ink cells of the screened cylinder and is transferred to the printing plates. To do this, the doctor blade chamber is presented in the form of a main body having a front face oriented near the screened cylinder. The main body presents a cavity designed to receive the ink. The cavity is closed by two flexible doctor blades that come into contact with the surface of the screened cylinder, and which are each maintained on the main body through a fastening clamp and fastening studs, or an air pocket if the chamber is a chamber with pneumatic doctor blades.

The doctor blades are arranged longitudinally and tangentially with respect to the screened cylinder. When the screened cylinder turns, the working doctor blade, also called the negative doctor blade, has a counter-rotation position. The negative doctor blade removes the excess of ink from the surface of the screened cylinder, while still distributing the ink from the cavity of the main body of the doctor blade chamber towards the inside of the cells in order to ensure a precise and repeatable volume. The negative doctor blade guarantees the distribution of a constant and sufficient quantity of ink towards the screened cylinder no matter the operating speed of the machine.

The sealing doctor blade, also called the positive doctor blade, seals the chamber. The role of the doctor blade is to maintain the seal of the chamber. In the event of over-inking, this may create an accumulation of liquid above the doctor blade. This accumulation of liquid must be channeled and recovered in the inking circuit.

However, because of the rotation of the screened cylinder, the surplus ink not transferred onto the printing plate accumulates outside the doctor blade chamber against the positive doctor blade. This ink then flows towards the end of the doctor blade chamber. This ink is lost and may clog the end parts of the doctor blade chamber. This is why all the end parts of the doctor blade chamber must often be cleaned. The operator must then proceed with the removal of the doctor blade chamber of the printing unit.

PRESENTATION OF THE INVENTION

A primary goal of the present invention consists of developing a doctor blade chamber which will allow making cleaning easier and decreasing the downtime of a printing machine as well as decrease the consumption of ink on a machine equipped with such a doctor blade chamber.

This invention provides a doctor blade, which is intended for a doctor blade chamber for a printing unit in flexography. The printing unit in flexography is equipped with a screened cylinder. The doctor blade is presented in the form of a rectangular blade, with a functional longitudinal edge of which one longitudinal edge is capable of coming into contact with the screened cylinder, with one longitudinal fastening side, and with two lateral sides.

The doctor blade is characterized in that it comprises at least one opening, which is located both towards the functioning longitudinal side and towards the first lateral side of the two sides.

In other words, one or several openings provided in the doctor blade allow the ink accumulating in the area of the ends of the doctor blade to escape outside the doctor blade chamber and outside the screened cylinder. Through the opening or openings, the ink accumulating in the area of the doctor blade is no longer dispersed, but is recovered in the inking circuit. Consequently, there is a decrease of losses of inks arriving continuously in the doctor blade chamber. The cleaning operations of the doctor blades and the doctor blade chamber are less burdensome and quicker.

The doctor blade provided with its opening or openings ensures the sealing function of the doctor blade chamber, by being placed on a sealing gasket, the latter being inserted into the cavity of the doctor blade chamber main body. The doctor blade equipped with its opening or openings ensures the sealing function of the doctor blade chamber, by being blocked by the fastening clamp.

A doctor blade is defined as being a directly sellable doctor blade and immediately ready to be mounted in the doctor blade chamber, or a doctor blade preform in the form of a rectangular blade that the operator must modify to provide the adequate opening or openings that comply with the invention, and to get the doctor blade ready to be mounted and to function in the doctor blade chamber.

According to one embodiment of the invention, the doctor blade comprises at least one second opening being located at the functional longitudinal side and being located at a second of the two lateral sides. The unused ink will be able to flow from the two sides of the doctor blade and thus from the two sides of the screened cylinder.

According to one embodiment of the invention, the opening is a notch provided in the area of the corner formed by the functional longitudinal side and the lateral side. With this hollowed out part in the corner, the doctor blade is easier to achieve.

According to one embodiment of the invention, the notch is presented in the form of a noticeably quadrangular cut. The opening or openings thus have maximal dimensions and an optimized shape.

According to one embodiment of the invention, the notch is presented in the form of a noticeably triangular cut. When an operator uses a preform of the doctor blade, he will directly cut the corner formed by the functional longitudinal side and the lateral side at a slant, so as to obtain this triangle shape. The cut to be made is consequently direct and simple to achieve whether done by the manufacturer of the doctor blade or by the operator from the preform.

According to one embodiment of the invention, the doctor blade includes a breakable area in one of the two lateral sides. This breakable area of the doctor blade, that is, in the event of a preform of the doctor blade, must be cut and thrown away afterwards. This breakable area of the doctor blade allows the operator to mount the doctor blade at the expected place on the doctor blade chamber, to stretch the doctor blade using a tool, for example pliers, placed in the area of the breakable area. Then the operator cuts the breakable area that has to be thrown away to get the definitive doctor blade.

According to one embodiment of the invention, the breakable area is positioned in the area of the corner formed by the first of the two lateral sides and the longitudinal fastening side. This corner is set at the opposite of the corner concerned by the opening or openings.

According to one embodiment of the invention, the breakable area is noticeably quadrangular. According to one embodiment of the invention, the breakable area is noticeably triangular. With one of these two noticeably quadrangular or triangular shapes, the operator easily cuts the breakable area once the doctor blade is mounted on the doctor blade chamber body.

According to one embodiment of the invention, the breakable area extends the strip of the doctor blade, which is located in the area of the notch. With this dimension planned for the noticeably quadrangular or triangular breakable area, the notch of the doctor blade keeps its own dimensions, as soon as the breakable area is removed.

According to one embodiment of the invention, the doctor blade is made of a plastic, steel, carbon, or even other material. Stainless steel may be used. The material of the doctor blade may also be coated in ceramics or carbon.

The invention also provides a doctor blade chamber. The doctor blade chamber is characterized in that it comprises at least one doctor blade according to the invention.

According to one embodiment of the invention, the doctor blade chamber includes one fastening clamp for the doctor blade and a gasket seal placed in the cavity of the main body of the doctor blade chamber. The doctor blade is positioned favorably on the gasket seal, such that an interior side of the notch is level with the interior edge of the fastening clamp and one lateral side of the notch is level with the exterior lateral face of the gasket seal.

The invention also provides a printing unit in flexography, of the type equipped with a screened cylinder. The printing unit in flexography is characterized in that it comprises a doctor blade chamber according to the invention, equipped with at least one doctor blade according to the invention.

BRIEF DESCRIPTION OF THE DRAWINGS

The invention will be clearly understood and its various advantages and different characteristics will be best emphasized from the following description, from the non-exhaustive embodiments, in reference to the appended schematic drawings, in which.

DETAILED PRESENTATION OF THE PREFERRED EMBODIMENTS

A printing machine, such as a flexography printing machine, comprises in particular one or several printing units, consecutive and arranged in a line, printing between one or several different colors, for example black, blue, red, green, and yellow.

Figure 1:
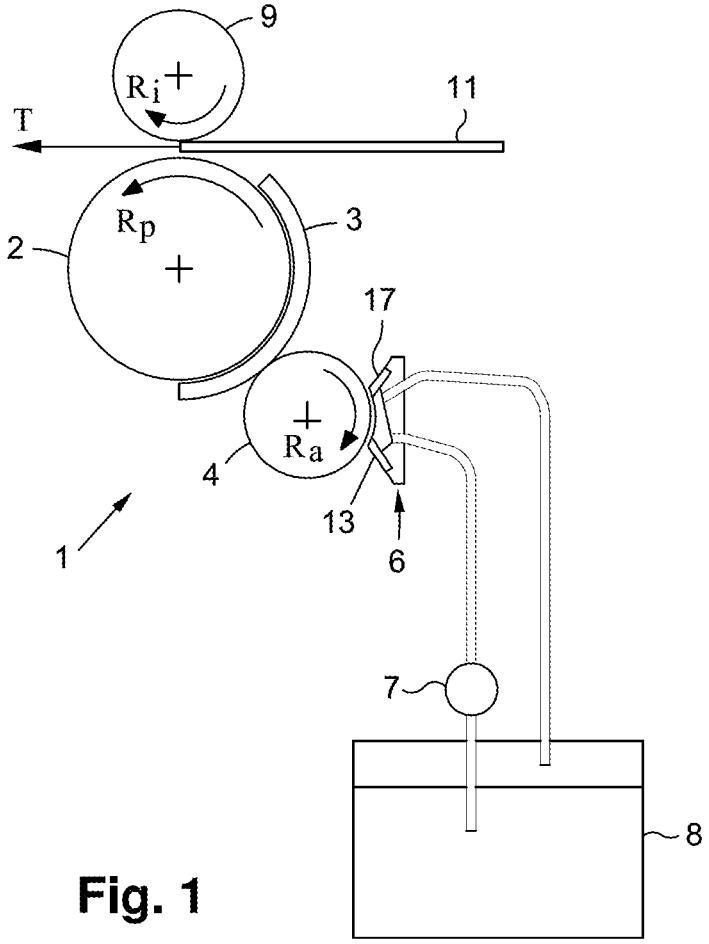
FIG. 1 represents a flexography printing unit comprising a doctor blade chamber equipped with doctor blades.

As this is represented in FIG. 1, a printing unit 1 comprises a plate cylinder 2 configured to support a printing form or plate 3. The printing plate 3 is rolled around the plate cylinder 2 and firmly fastened. The printing unit 1 comprises a screened cylinder or anilox cylinder 4, presenting on its surface a set of cells designed to gather the ink in a quantity controlled by the volume of the cells. When it rotates (Arrow Ra), the screened cylinder 4 transfers the ink onto the printing plate 3.

Printing unit 1 comprises a doctor blade chamber 6, configured to fill the cells of screened cylinder 4 when it turns (Arrow Ra). Printing unit 1 comprise at least one pump 7, as well as the adequate circuitry, ensuring the delivery of the ink from an ink tank 8 towards doctor blade chamber 6. Printing unit 1 includes a rotating counterpressure cylinder (Arrow Ri) 9 holding and transporting (Arrow T) medium 11 during printing. When it rotates (Arrow Rp), plate cylinder 2 prints the pattern of printing plate 3 onto medium 11.

Figure 2:
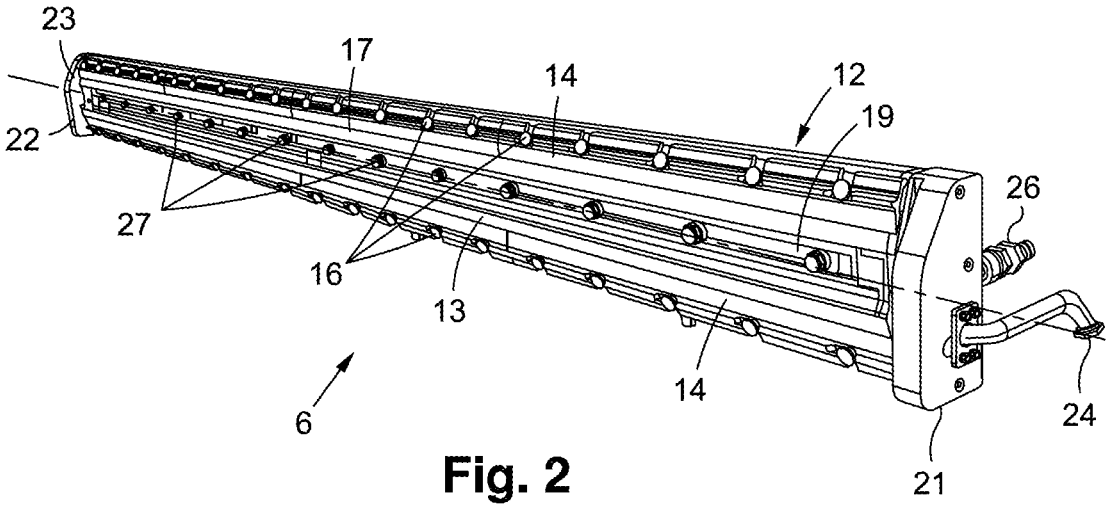
FIG. 2 represents a perspective view of the doctor blade chamber.

Doctor blade chamber 6 comprises a main body 12 (see FIG. 2). Doctor blade chamber 6 also comprises a first doctor blade, which is negative doctor blade 13 (see FIGS. 1 and 2). Negative doctor blade 13 is mounted by being pressed against a first flat portion of main body 12. Negative doctor blade 13 is firmly fastened at the first flat portion by being retained under, and blocked through a fastening clamp 14. Fastening clamp and thus negative doctor blade 13 are then blocked by several units of the studs or attachment screws type 16.

In addition, doctor blade chamber 6 comprises a second doctor blade, which is positive doctor blade 17 (see FIGS. 1 and 2). Positive doctor blade 17 is mounted by being pressed against a second flat portion of main body 12, facing to negative doctor blade 13. Positive doctor blade 17 is firmly fastened at the second flat portion by being retained under, and blocked though a fastening clamp 14. Fastening clamp 14 and thus positive doctor blade 17 are blocked by several units of a studs or attachment screws type 16, in a way analogous to fastening clamp 14. It should be noted that, in the case of a pneumatic doctor blade chamber (not represented), the fastening clamps may be brought closer to or distanced from main body 12, to catch or on the contrary to release negative doctor blade 13 and positive doctor blade 17, through two respective air pockets.

Fastening clamps 14 may be the same length as negative doctor blade 13 and positive doctor blade 17 or of a shorter length. In cases where fastening clamps 14 are of a shorter length than negative doctor blade 13 and respectively than positive doctor blade 17, several fastening clamp elements are installed end to end so as to cover the length of negative doctor blade 13 and respectively positive doctor blade 17.

Negative doctor blade 13 and positive doctor blade 17 face each other and partially close a cavity 19, which is designed to receive the link and which is formed in main body 12. Fastening clamps 14 of negative doctor blade 13 and positive doctor blade 17 each comprise an interior edge which is oriented towards the interior of cavity 19.

Doctor blade chamber 6 comprise a first end part 21 and a second end part 22. Each end part 21 and 22 is arranged by being inserted into a respective end of main body 12 of doctor blade chamber 6. The two lateral edges of negative doctor blade 13 and positive doctor blade 17 are each in contact with an interior face 23 oriented towards cavity 19, end parts 21 and 22.

The first end part 21 includes an ink channel 24 opening into main body 12, and ensuring the supply of ink from doctor blade chamber 6 coming from pump or pumps 7 and ink reservoir 8. The first end part 21 also comprises a water channel 26 opening into main body 12 via a series of washing nozzles 27, and insuring the washing water supply of doctor blade chamber 6 coming from a water tank or a water source.

Figure 3:
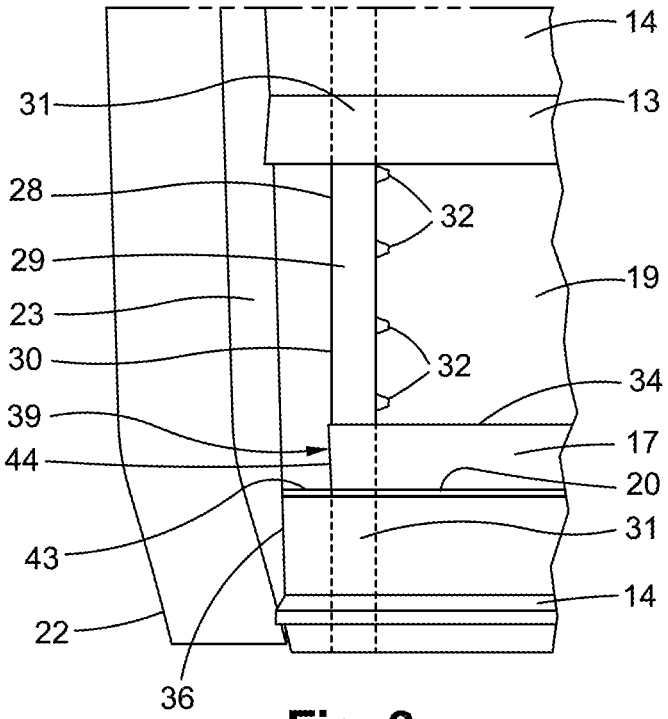
FIG. 3 represents a partial top view of one end of the doctor blade chamber.

As seen in FIG. 3, cavity 19 of main body 12 of doctor blade chamber 6 is closed at each one of its two ends by a gasket seal 28. Gasket seal 28 is made out of foam or elastomer, and is mounted against the interior face of cavity 19.

Seal gasket 28 presents an apparent concave surface in an arc of a circle 29. When doctor blade chamber 6 is positioned against screened cylinder 4, concave surface 29 of the seal gasket comes in direct contact with one of the two peripheral ends of screened cylinder 4. Seal gasket 28 also presents an interior lateral face, oriented towards cavity 19 and in contact with the ink, as well as an exterior lateral face 30. Seal gasket 28 is set away from end parts 21 and 22, so as to release a volume. Exterior lateral face 30 of seal gasket 28 does not come in contact with interior face 23 oriented towards cavity 19, end parts 21 and 22.

Two lateral end areas of the interior surface of negative doctor blade 13 and positive doctor blade 17 that are in contact with the ink come to lie on two respective support surfaces 31 provided on seal gasket 28. Seal gasket 28 is inserted into longitudinal pins 32 and these pins ensure that it is kept in place.

Negative doctor blade 13 is most often made out of metal. Positive doctor blade 17 is most often made out of a polymer material. The polymer material is preferably chosen in the group including ultra-high molecular mass polyethylenes known as high-density polyethylenes (UHMWPE).

The doctor blades, whether positive doctor blade 17 or negative doctor blade 13, are thin, elongated, and rectangular blades. A blade of positive doctor blade 17 has a first longitudinal fastening side 33. Longitudinal fastening side 33 is located under fastening clamp 14, when positive doctor blade 17 is mounted on the main body 12 of doctor blade chamber 6. The edge of longitudinal fastening side 33 of positive doctor blade 17 is set against attachment studs 16 or against a flange provided on main body 12, to ensure the parallelism of positive doctor blade 17 in relation to main body 12, doctor blade chamber 6, and a generator of screened cylinder 4.

The same blade has a second free and functional longitudinal side 34, opposite and parallel to the first longitudinal fastening side 33. A functional longitudinal edge of free and functional longitudinal side 34 is capable of coming into contact with screened cylinder 4, by being supported through biasing means.

The blade also has two short lateral sides 36 and 37 and perpendicular to the first longitudinal fastening side 33 and to the second free and functional longitudinal side 34. The lateral edge of each of the two short lateral sides 36 and 37 is in contact with interior face 23 oriented towards cavity 19.

According to a first embodiment of the invention (see FIG. 4), doctor blade 38 comprises at least one opening 39, allowing the ink, that has not coated the printing plate 3 and which is recovered after a rotation of screened cylinder 4, to escape. Opening 39 is located towards functional longitudinal side 34 and towards the first lateral side 36 of the two lateral sides 36 and 37. The first lateral side 36 is in this case the left side, when functional longitudinal side 34 is oriented towards the top. The first opening 39 is preferably a notch, that is, material directly removed in the area of the corner formed by functional longitudinal side 34 and the first lateral side 36.

According to a second embodiment of the invention (see FIG. 5), doctor blade 41 comprises at least one first opening 39, analogous to the one described above for the first embodiment, and at least a second opening 42. The first opening 39 and the second opening 42 allow the ink, that has not coated the printing plate 3 and which is recovered after a rotation of screened cylinder 4, to escape. The second opening 42 is located towards functional longitudinal side 34 and towards the second lateral side 37 of the two lateral sides 36 and 37. The second opening 42 is longitudinally opposite the first opening 39. The second lateral side 37 is in this case the right side, when functional longitudinal side 34 is oriented towards the top. Similarly to the first opening 39, the second opening 42 is preferably a notch, that is, material removed in the area of the corner formed by functional longitudinal side 34 and the second lateral side 37.

The notch of the first opening 39 or the second opening 42, is presented in the form of a noticeably quadrangular shape, presenting an interior side 43, parallel to functional longitudinal side 34. The cut also presents a transversal side 44, perpendicular to the interior side 43 and parallel to the first and second lateral side 36 and 37.

According to a third embodiment of the invention (see FIG. 6), doctor blade 45 comprises at least a first opening 39 and at least a second opening 42. The first opening 39 and the second opening 42 allow the ink that has not coated the printing plate 3 and which is recovered after a rotation of screened cylinder 4, to escape. The first opening 39 is located towards functional longitudinal side and towards the first lateral side 36 of the two lateral sides 36 and 37. The second opening 42 is located towards functional longitudinal side 34 and towards the second lateral side 37 of the two lateral sides 36 and 37. The second opening 42 is thus longitudinally opposite the first opening 39.

The first opening 39 and the second opening 42 are preferably a notch, that is, material removed at the corner formed by functional longitudinal side 34 and the first lateral side 36 and the second lateral side 37.

The notch of the first opening 39 and the second opening 42 is presented in the form of a cut in a noticeably triangular shape, presenting a slanted side 46, for example at 45° relative to the functional longitudinal side 34.

The doctor blade of the first embodiment 38, of the second embodiment 41, or of the third embodiment 45 is held on seal gasket 28 in cavity 19 of main body 12 of doctor blade chamber 6 (see FIG. 3). Doctor blade 38 or 41 is positioned by the operator, so that interior side 43 of the first opening 39 and/or of the second opening 42 is level with interior edge 20 of fastening clamp 14. Doctor blade 38 or 41 is also positioned by the operator, so that transversal side 44 of the first opening 39 and/or of the second opening 42 is level with exterior lateral face 30 of seal gasket 28.

Figure 5:
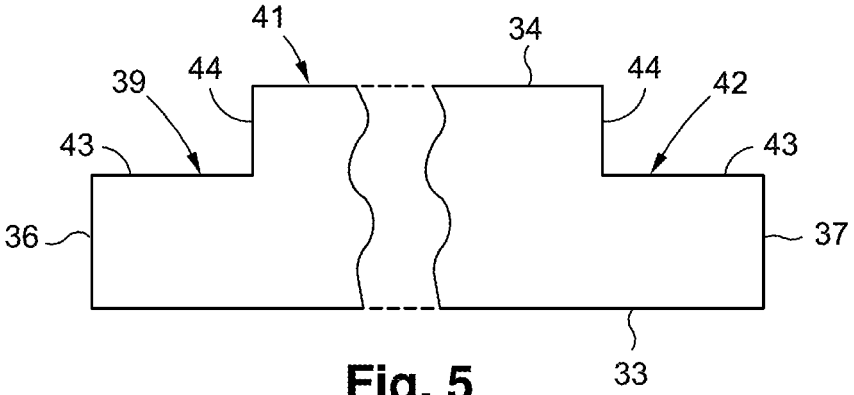
Figure 7:
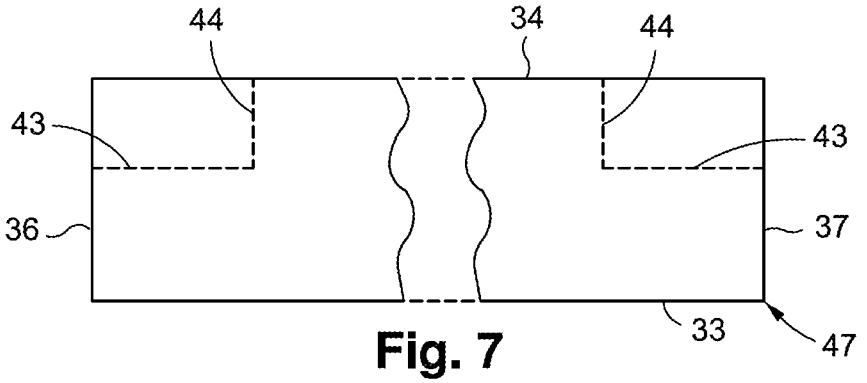
FIGS. 7 to 9 represent a partial top view of three alternatives of a doctor blade preform, which allow obtaining the doctor blade according to the invention.

In a first alternative (see FIG. 7), a preform of doctor blade 47 allows the operator to obtain doctor blade 41 according to the second embodiment (FIG. 5). The preform of doctor blade 47 presents potentially the two openings 39 and 42. The two openings 39 and 42 may be materialized by a marking making interior side 43 and transversal side 44 visible (dashes in FIG. 7). The operator must then cut openings 39 and 42 in the shape of a quadrangular notch, with a cutting tool, scissors, cutter, or other tools. The two openings 39 and 42 may also be precut in the material of the preform of doctor blade 47, in order to diminish the lines giving interior side 43 and transversal side 44. The operator must then cut out these two corners by following the precuts in order to create openings 39 and 42.

Figure 4:
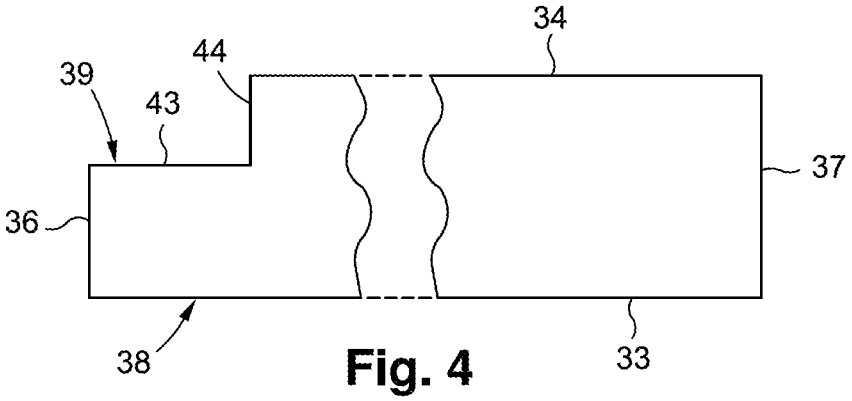
FIGS. 4 to 6 represent a partial top view of a doctor blade respectively according to a first, second, and third embodiment of the invention.
Figure 6:
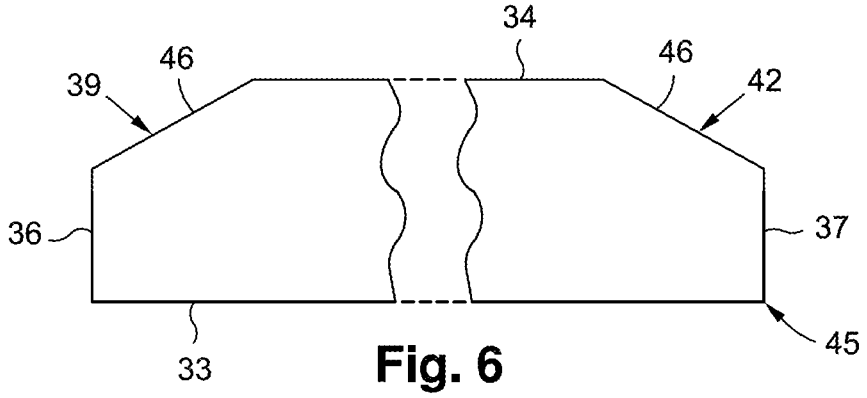

In another alternative, a doctor blade preform (not represented) may also be done to allow the operator to obtain doctor blade 38 with the first opening 39 in the shape of a quadrangular notch, according to the first embodiment (FIG. 4). In an analogous manner and in even yet another alternative, a doctor blade preform (not represented) can also be made to allow the operator to obtain doctor blade 45 with the two openings 39 and 42 in the shape of a triangular notch, according to the third embodiment of the invention (FIG. 6).

Figure 8:
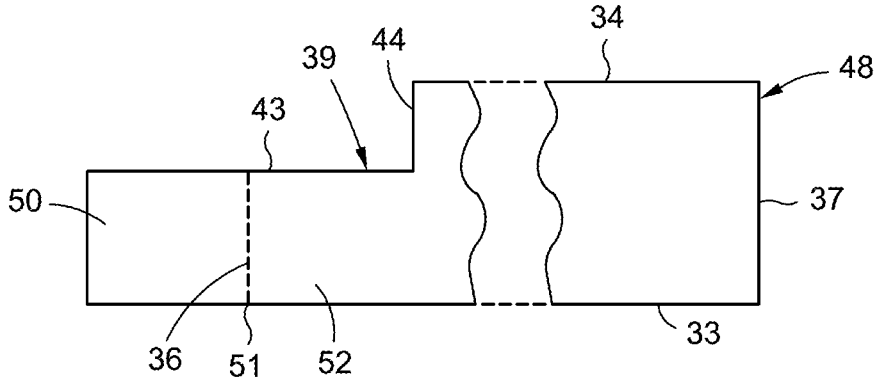
Figure 9:
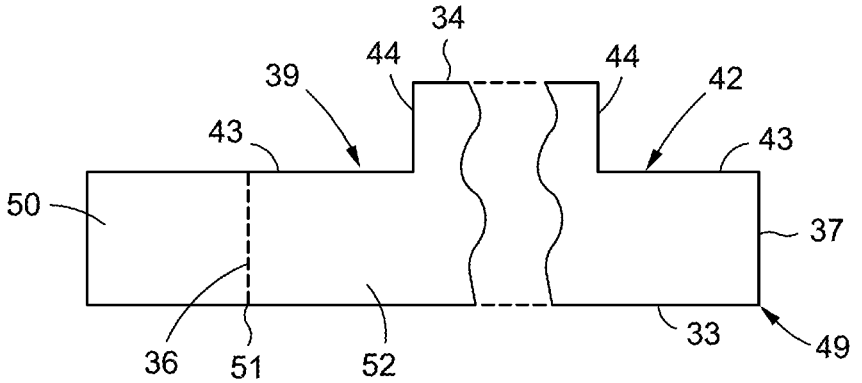

In a second alternative (see FIG. 8), a preform of doctor blade 48 allows the operator to obtain doctor blade 38 according to the first embodiment (FIG. 4). In a third alternative (see FIG. 9), a preform of doctor blade 49 allows the operator to obtain doctor blade 41 according to the second embodiment (FIG. 5). In a fourth alternative (not represented), a doctor blade preform allows the operator to obtain doctor blade 45 according to the third embodiment (FIG. 6).

For the second, third, and the fourth alternatives, the preform of doctor blade 48 and 49 include a breakable area 50, provided in one of the two lateral sides 36. Breakable area 50 is located in the area of the corner 51 formed by the first of the two lateral sides 36 and the longitudinal fastening side 33.

Breakable area 50 of the doctor blade preforms of the second alternative 48 (FIG. 8) and third alternative 49 (FIG. 9) is noticeably quadrangular. Breakable area 50 of the doctor blade preforms 48 and 49 advantageously extends strip 52 of doctor blades 48 and 49 and thus the respective doctor blades 38 and 41, which is located in the area of notch 39, that is, delimited by interior side 43, longitudinal fastening side 33, and the extension of the transversal side 44. The breakable area of the doctor blade preform according to the fourth alternative may also be noticeably quadrangular.

The breakable area of the doctor blade preform according to the second alternative, the third alternative, and the fourth alternative may also be noticeably triangular. In the case of the fourth alternative, the breakable area of the doctor blade preform thus extends preferably the strip of the doctor blade preform and thus doctor blade 45, which is located in the area of notch 39, that is, limited by slanted side 46, longitudinal fastening side 33.

Figure 10:
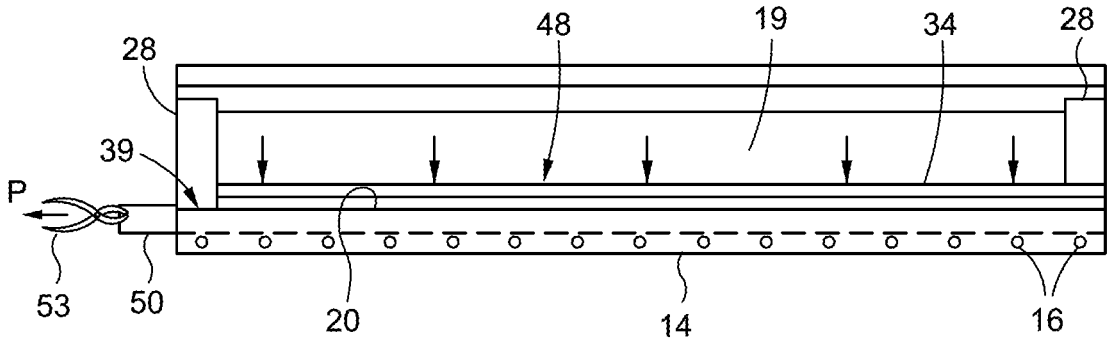
FIG. 10 represents a top view of the doctor blade chamber, with one of the doctor blade preforms is the mounting process.

To obtain ready for use doctor blade chamber 6, the operator mounts the doctor blade preform 48, for example, according to the second alternative of embodiment (FIG. 8) by placing it on main body 12 of doctor blade chamber 6. Then the operator places fastening clamp 14 and places and screws a small number of attachment studs 16, for example two or three, at the end opposite the breakable area 50, in order to start the blocking of the preform of doctor blade 48. The operator then pulls (Arrow P in FIG. 10) the preform of doctor blade 48 with pliers 53 to stretch it out, and then places and screws the remainder of the attachment studs 16. The operator then finally breaks breakable area 50 to obtain doctor blade 38 according to the first embodiment (FIG. 4).

To obtain a ready to use pneumatic doctor blade chamber, the operator mounts the doctor blade preform by placing in on the main body of the doctor blade chamber. Then the operator activates the air inlet that presses the fastening clamp, in order to block the doctor blade preform. The operator then cuts the breakable area to obtain the doctor blade.

This invention is not limited to the implementations described and illustrated. Numerous modifications may be done, without getting away from the framework defined by the scope of the set of claims.

The invention claimed is:

1. A doctor blade chamber comprising:

a main body;

a fastening clamp;

a seal gasket, the seal gasket being placed in a cavity of the main body of the doctor blade chamber; and a doctor blade for use with a screened cylinder, the doctor blade comprising a blade, with a functional longitudinal side, a longitudinal fastening side, and two lateral sides, the functional longitudinal side including a longitudinal edge to make contact with the screened cylinder, wherein the doctor blade includes at least one opening located towards the functional longitudinal side and towards a first of the two lateral sides, and wherein the doctor blade is positioned on the seal gasket, so that one interior side of the at least one opening is level with an interior edge of the fastening clamp for the doctor blade, and so that a lateral side of the at least one opening is level with an exterior lateral face of the seal gasket.

2. The doctor blade chamber of claim 1, wherein the doctor blade further includes at least a second opening located towards the functional longitudinal side and towards a second of the two lateral sides.

3. The doctor blade chamber of claim 1, wherein the at least one opening is a notch provided in an area of a corner formed by the functional longitudinal side and the first of the two lateral sides.

4. The doctor blade chamber of claim 3, wherein the notch is presented in a form of a noticeably quadrangular cut.

5. The doctor blade chamber of claim 3, wherein the notch is presented in a form of a noticeably triangular cut.

6. The doctor blade chamber of claim 1, wherein the doctor blade further includes a breakable area provided in one of the two lateral sides, and wherein the breakable area has a shape that is noticeable by an operator to guide the operator to cut the breakable area to form the at least one opening.

7. The doctor blade chamber of claim 6, wherein the breakable area is positioned in an area of a corner formed by the first of the two lateral sides and the longitudinal fastening side.

8. The doctor blade chamber of claim 6, wherein the breakable area is noticeably quadrangular or triangular.

9. The doctor blade chamber of claim 6, wherein the breakable area extends a strip of the doctor blade located in an area of the at least one opening.

10. The doctor blade chamber of claim 1, wherein the doctor blade is made in a plastic, steel, or carbon material.

11. The doctor blade chamber of claim 1, wherein the at least one opening is not in fluid communication with a cavity of the doctor blade chamber that is sealed by the doctor blade.

12. The doctor blade chamber of claim 1, wherein the doctor blade is dimensioned to seal ink in the doctor blade chamber, and the at least one opening provides a passage for ink to pass by the doctor blade outside the doctor blade chamber to be recovered.

13. A flexography printing unit including the doctor blade chamber as claimed in claim 1.

14. The doctor blade chamber of claim 1, wherein an entirety of the at least one opening is provided outside the fastening clamp when the fastening clamp is fastened.

15. The doctor blade chamber of claim 1, wherein ink from the screened cylinder accumulating on an area of the doctor blade exterior to a cavity of the doctor blade chamber is recovered through the at least one opening into an inking circuit.

16. A doctor blade chamber comprising:

a main body forming a cavity;

a seal provided on the main body, and including an interior part facing the cavity and an exterior part facing away from the cavity toward a longitudinal end of the main body;

an end part provided at the longitudinal end of the main body on an opposite side of the seal from the cavity; and a doctor blade having a first portion extending from the cavity to the seal and ending between the interior part and the end part, and a second portion extending from the cavity to the end part.

17. The doctor blade chamber of claim 16, wherein the main body, the seal, and the doctor blade form a contact surface for a printing cylinder to retain ink in the cavity between the doctor blade chamber and the printing cylinder.

18. The doctor blade chamber of claim 17, wherein the main body, the seal, and the doctor blade are arranged to collect ink, that accumulates on a surface of the doctor blade outside the cavity, between the seal and the end part, to be recovered by an inking circuit in fluid communication with the cavity.

19. The doctor blade chamber of claim 17, wherein the doctor blade is provided as a leading edge of the doctor blade chamber against the printing cylinder relative to a direction of rotation of the printing cylinder.

20. The doctor blade chamber of claim 16, further comprising:

a fastening clamp to hold the doctor blade against the seal, wherein a total length of the fastening clamp corresponds at least with a total length of the second portion of the doctor blade, and a boundary between the first portion and the second portion of the doctor blade is aligned with an edge of the fastening clamp.

* * * * *